US005474237A

United States Patent [19]

Bishop et al.

[11] Patent Number: 5,474,237

[45] Date of Patent: Dec. 12, 1995

[54] METHOD AND APPARATUS FOR ELIMINATING SCREEN PLUGGING IN WET GRINDING MILLS

[75] Inventors: John F. Bishop; Karen E. Maskasky, both of Rochester, N.Y.

[73] Assignee: Eastman Kodak Company, Rochester, N.Y.

[21] Appl. No.: 396,440

[22] Filed: Feb. 28, 1995

[51] Int. Cl.[6] ..... B02C 17/16

[52] U.S. Cl. ..... 241/21; 241/24; 241/33; 241/46.17; 241/171; 241/172

[58] Field of Search ..... 241/21, 22, 24, 241/33, 46.17, 79, 172, 171, 174

[56] References Cited

U.S. PATENT DOCUMENTS

| | | | |
|---|---|---|---|
| 3,017,342 | 1/1962 | Bulat et al. | 208/11 |
| 4,042,179 | 8/1977 | Myers et al. | 241/46.11 |
| 4,151,067 | 4/1979 | Grow | 208/11 |
| 4,326,855 | 4/1982 | Cottell | 44/51 |
| 4,401,437 | 8/1983 | Poetschke et al. | 44/2 |
| 4,403,997 | 9/1983 | Poetschke | 44/2 |
| 4,613,084 | 9/1986 | Takamoto et al. | 241/16 |
| 4,651,935 | 3/1987 | Samosky et al. | 241/65 |
| 4,709,863 | 12/1987 | Szkaradek et al. | 241/69 |
| 4,834,301 | 5/1989 | Inkyo et al. | 241/33 |
| 4,985,149 | 1/1991 | Ohshima et al. | 210/603 |
| 5,024,387 | 6/1991 | Yeh | 241/21 |
| 5,115,864 | 5/1992 | Gaidry et al. | 166/278 |
| 5,150,753 | 9/1992 | Gaidry et al. | 166/278 |
| 5,333,804 | 8/1994 | Liebert | 241/69 |
| 5,335,867 | 8/1994 | Stehr et al. | 241/69 |

*Primary Examiner*—Mark Rosenbaum
*Assistant Examiner*—John M. Husar
*Attorney, Agent, or Firm*—Carl F. Ruoff

[57] ABSTRACT

The present invention provides method and apparatus to continuously operate a bead mill. At the outlet of the bead mill is a separator screen which prevents particles of a certain size from being discharged. After running the bead mill, the screen tends to get clogged with large sized particles. The present invention provides an ultrasonic probe that periodically cleans the screen when the pressure within the milling chamber reaches a predetermined value.

6 Claims, 4 Drawing Sheets

METHOD AND APPARATUS FOR ELIMINATING SCREEN PLUGGING IN WET GRINDING MILLS

FIELD OF THE INVENTION

The present invention relates to an improved method and apparatus for grinding solid particles or mixing photographic dispersions.

BACKGROUND OF THE INVENTION

Many industries utilize wet grinding and dispersion equipment for size reduction in dispersion processes to prepare very find dispersions of solid particles suspended in liquid medium. This wet grinding process is commonly used for photographic, pharmaceutical, cosmetic, electrical and other applications requiring fine particle formation. The processing chamber of these devices are commonly filled with small grinding beads which occupy up to eighty or ninety percent of the volume within the chamber. The agitation of these beads in the presence of the liquid dispersion containing the solid particles results in ultra-fine size reduction. The large number of contact points provided by the grinding beads provides an efficient way to impart energy into the dispersion or particles to be ground.

These continuous grinding mills are fitted with retention screens on the product outlet of the grinding chamber to retain the grinding beads and oversized product in the grinding zone and allow the liquid dispersion to flow continuously through this active grinding zone. The cylindrical screen cartridges are commonly used for fine grinding media and are useful on larger production mills. However, the screen openings of the cylindrical screen cartridges are prone to plugging and require frequent cleaning during the wet grinding process. In addition, dispersions exhibiting pseudo-plastic flow behaviors can build up a high resistance to flow and result in excessive pressures in the grinding chamber. Such screens are prone to plugging by large undispersed particles in the liquid phase and fine beads or bead fragments. Screen plugging results in reduced run times, process variability and reduced process reliability. In addition, higher production costs are associated with screen clogging. To use grinding beads in these mills requires very narrow size distribution of the beads and requires intensive bead sieving and bead preconditioning to remove any residual fines. In most cases additional bead preconditioning is required to remove beads that may fragment during the milling process. These processing steps increase the unit costs of manufacturing dispersed systems.

The present invention provides an advantage over the prior art by extending the commercially useful process latitude of existing bead milling technology to operate continuously to manufacture dispersed systems.

SUMMARY OF THE INVENTION

The present invention is a wet milling apparatus which includes a milling chamber having an inlet port for introducing media to be milled and an outlet port for discharging the milled media. Grinding means are contained within the chamber. A screen covering the outlet port having a predetermined mesh size is provided. An ultrasonic probe is positioned on the outlet side of the screen and a pressure sensor for measuring pressure within the milling chamber is also provided. Control means which activate the ultrasonic probe when the pressure in the chamber reaches a predetermined value are provided. This apparatus prevents clogging of the screen and allows one to use the milling apparatus continuously.

The present invention is also a method for eliminating screen clogging in a wet grinding mill which includes introducing a dispersion of solid particles into a wet grinding mill chamber. The dispersion is ground in the grinding mill chamber. The ground dispersion is discharged through an outlet screen in fluid communication with the grinding chamber. The ground dispersion can be recycled for further fine grinding. The pressure within the grinding chamber is monitored and an ultrasonic probe positioned on the outlet side of the screen is activated when the pressure within the grinding mill reaches a predetermined value.

The present invention provides the advantage of using finer grinding media within a grinding mill. It expands the process capability of this technology to use more polydisperse and cheaper grinding media. The present invention also has the advantage of reducing the cost of dispersion preparation in manufacturing. Finally, the present invention extends the capability of the wet milling grinding process to handle and reduce large particle aggregates.

For a better understanding of the present invention, together with other and further advantages and capabilities thereof, preference is made to the following detailed description of appended claims in connection with the preceding drawings and description of some aspects of the invention.

DETAILED DESCRIPTION OF THE PREFERRED EMBODIMENTS

Figure 1:
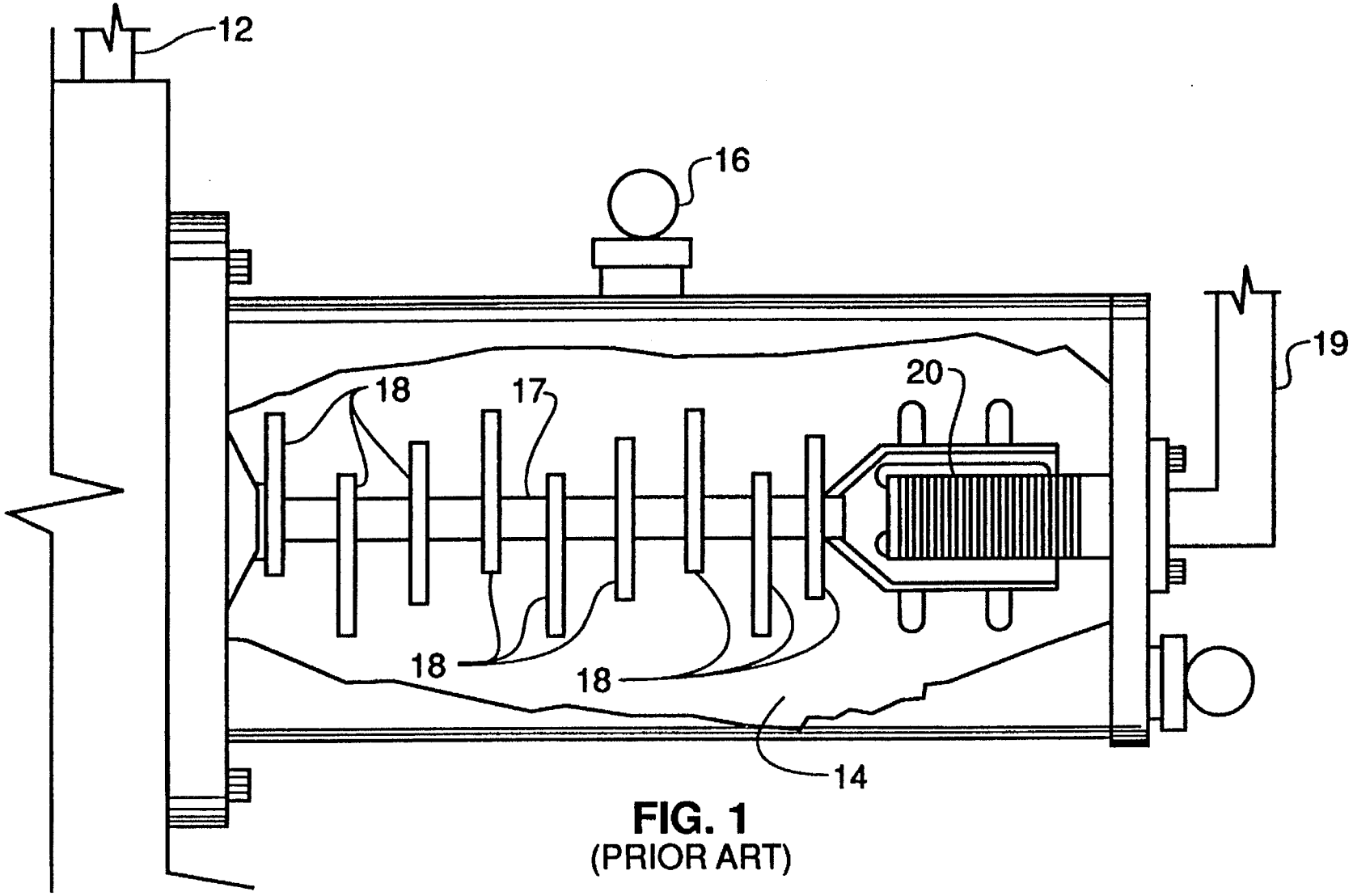
FIG. 1 (PRIOR ART)
FIG. 1 is a sectional schematic of a prior art milling mill.
Figure 2:
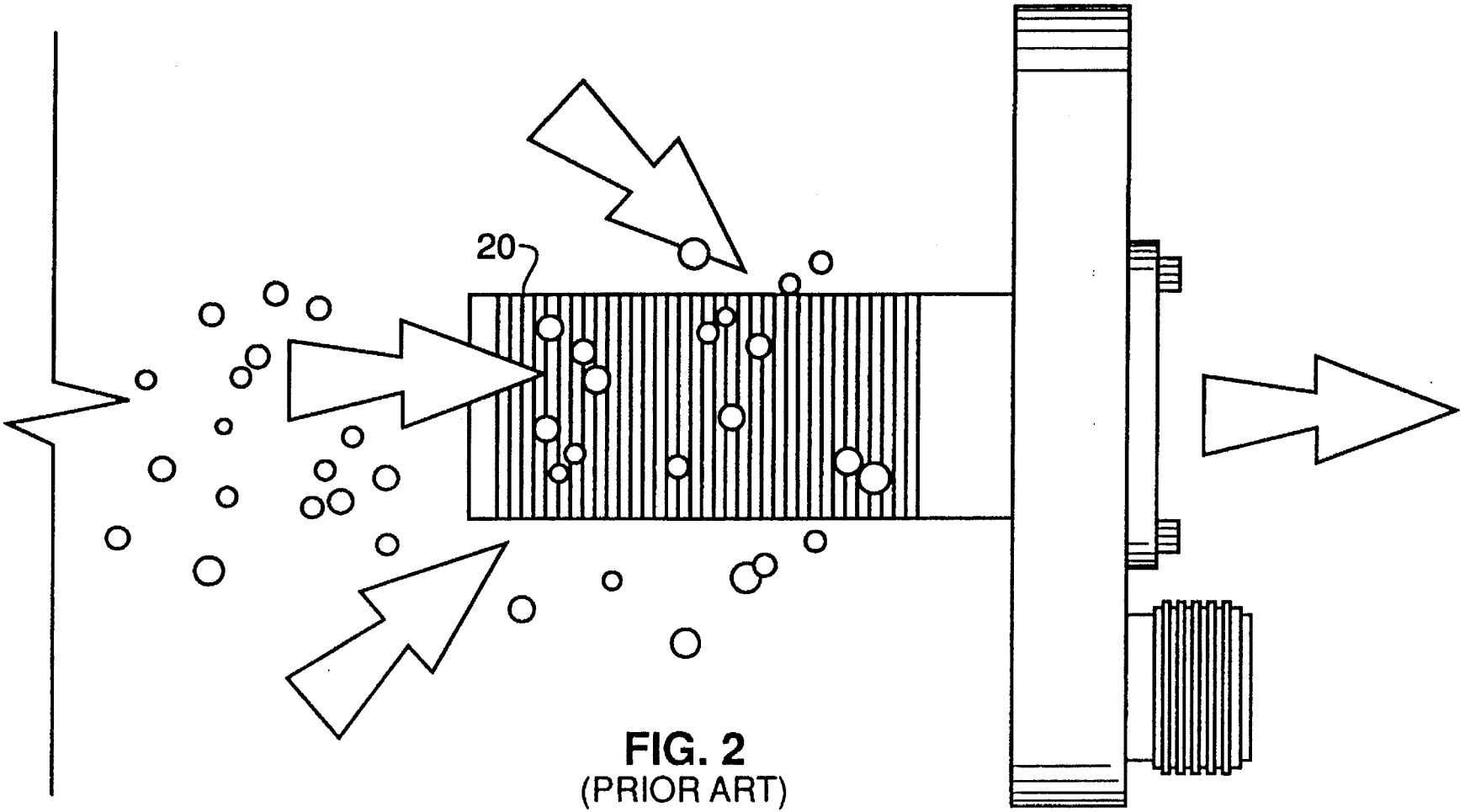
FIG. 2 (PRIOR ART)
FIG. 2 shows a cartridge separator screen used in the milling mill of FIG. 1.

FIGS. 1 and 2 represent schematic diagrams of an agitated bead mill utilizing grinding beads and a cylindrical separator screen at the dispersion discharge outlet of the grinding mill. The grinding mill includes a product inlet port 12 for introducing product into the milling chamber 14. The grinding beads are introduced into the milling chamber 14 through port 16. The grinding mill shown in FIG. 1 also includes a rotating shaft 17 of eccentric or concentric milling disks 18. The product, which is ground in chamber 14, is discharged through product outlet 19. A cylindrical cartridge separator screen 20 surrounds the outlet port 19. As shown in FIG. 2, the cylindrical separator screen prevents particles of a predetermined size from being discharged through the outlet port. However, as the cylindrical separator screen openings become smaller and smaller, the screen is more prone to plugging from particles and particle aggregates. When this occurs, pressure in the milling chamber builds up until the grinding mill must be shut down and the screen must be removed and cleaned. The present invention solves this problem and allows continuous operation of the bead mill.

Figure 3:
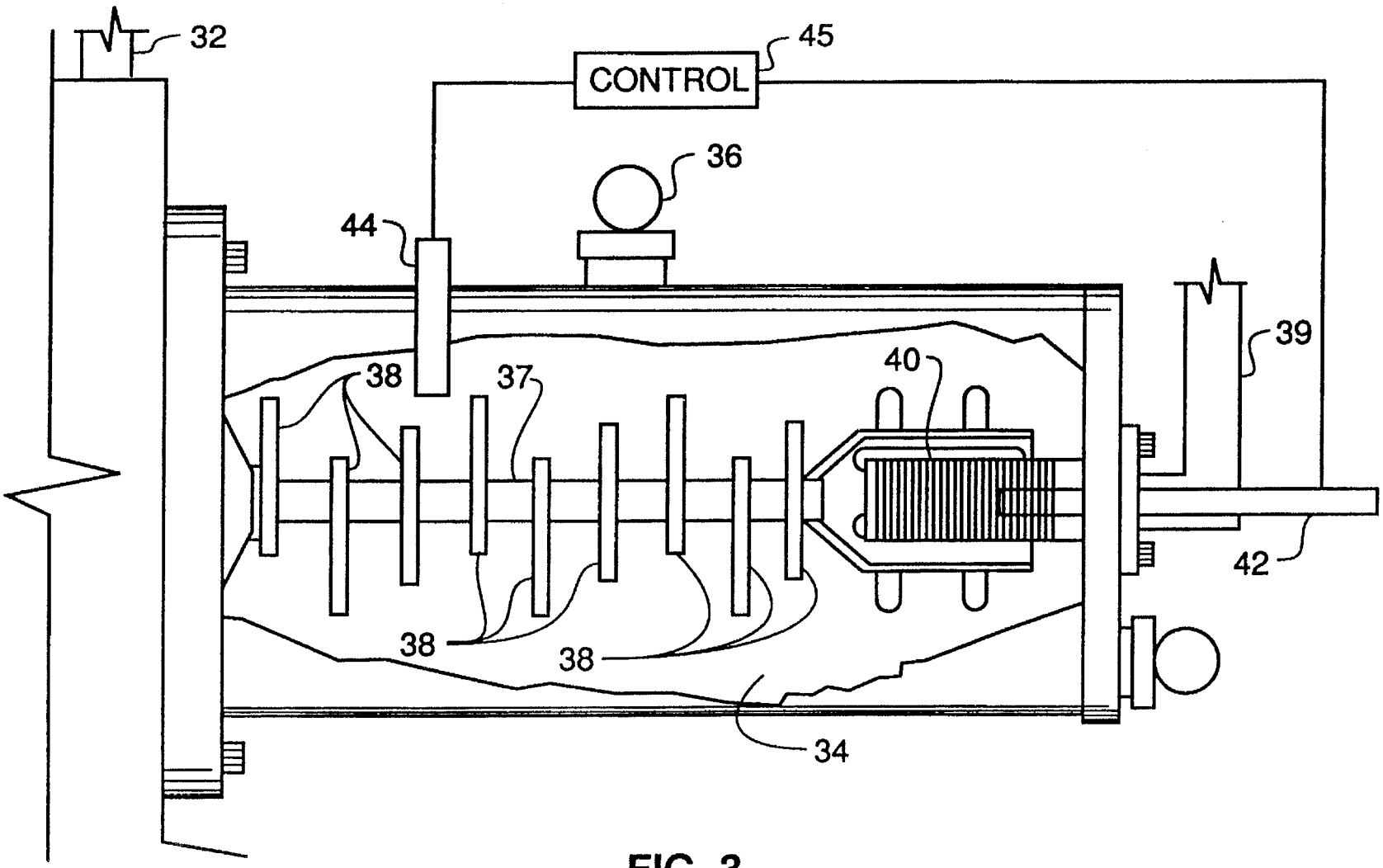
FIG. 3 shows a sectional schematic of the milling mill of the present invention.
Figure 4:
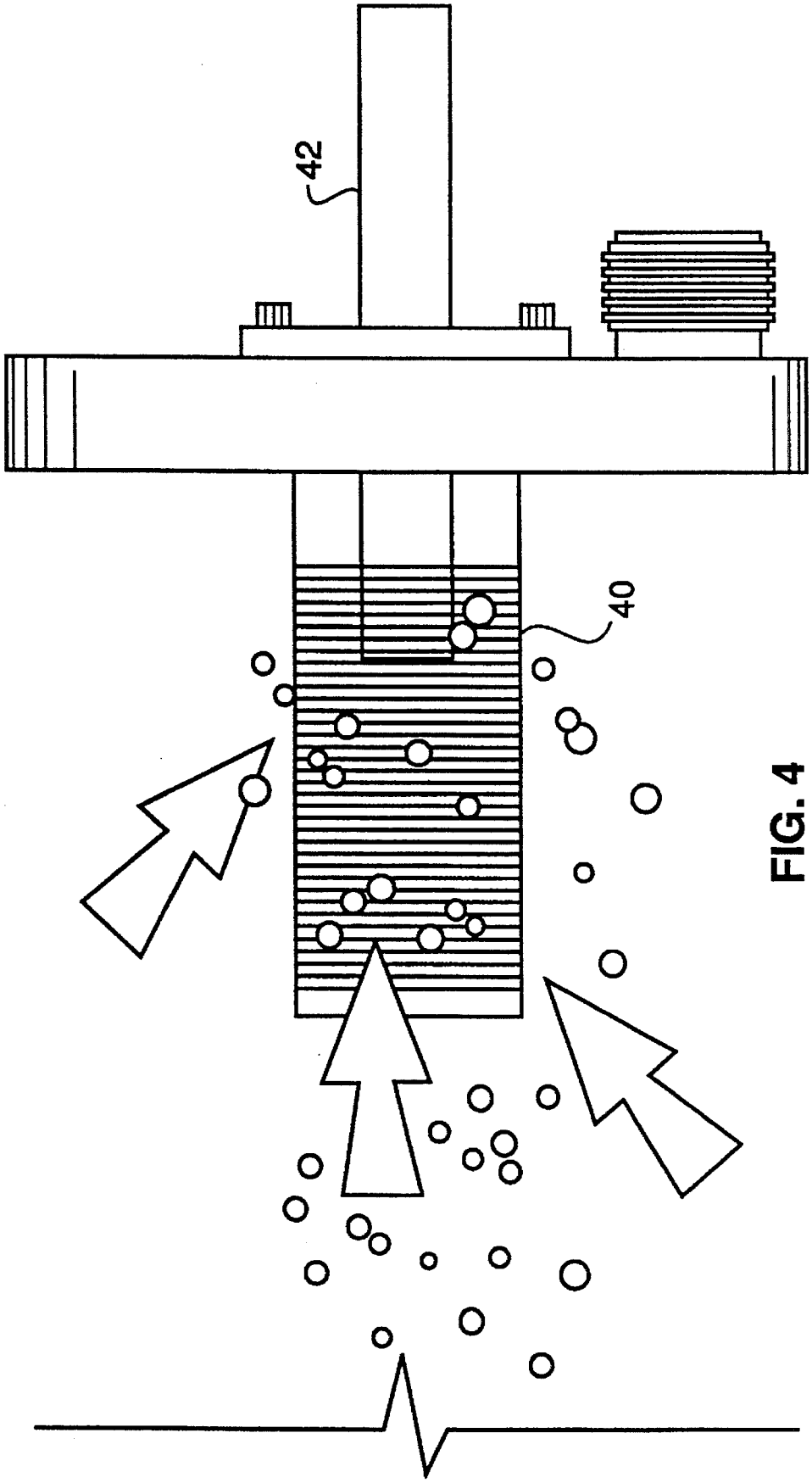
FIG. 4 shows the cartridge separator screen used in the media mill of FIG. 3.

Shown in FIGS. 3 and 4 are the agitated bead mill and cylindrical separator screen of the present invention. FIG. 3 shows a product inlet port 32, which allows introduction of product to be ground into the milling chamber 34. Grinding media is introduced into the chamber through media input port 36. The mill of the present invention also contains a shaft 37 containing eccentric milling disks 38. Ground product is discharged through product outlet 39. FIG. 3 also shows an ultrasonic probe 42 positioned on the outlet side of cylindrical separator screen 40. In addition, a pressure sensor 44 is used to monitor the pressure within the milling chamber 34. Control means 45 couple the pressure sensor 44 and the ultrasonic probe 42 so that when pressure in the milling chamber reaches a predetermined value the ultrasonic probe is activated and cleans the particles lodged in the cylindrical cartridge screen. This is done while the bead mill is still operating thereby allowing continuous operation of the bead mill.

Example 1

The milling apparatus shown in FIG. 3 was used to test the present invention. The grinding mill contained a four liter grinding chamber which was filled with polymeric grinding beads. A solution of ten percent polyvinylpyrrolidone "PVP" in water was used to study the invention and the dispersed solid phase was eliminated to simplify verification of the invention. The following process parameters were used in operating the grinding mill to study the present invention. The shaft speed was set at 2200 RPM. Eccentrically mounted disks were mounted on the shaft as shown in FIG. 3. The separator screen had a 0.2 mm opening. The PVP flowrate was 350–800 cc/min. The grinding mill type was a model LME 4 manufactured by Netzsch Inc. The grinding media size was 0.4–0.6 mm with two percent fines less than 0.3 mm.

The grinding mill was charged 87%–93% by volume with grinding beads and the "PVP" solution was pumped continuously through the milling chamber. The chamber pressure was monitored continuously. Additional subsized media less than 0.3 mm in diameter was added to the milling chamber to induce screen plugging. The extent of screen plugging was indicated by the pressure reading in the milling chamber. Once the screen plugging began, the pressure in the grinding zone rose from 0.4 bar to 1.3 bar in about five minutes. Since the grinding mill is not practically operable above 1.5 bar, the milling event would normally be discontinued or the mill would automatically shut off. However, an ultrasonic probe was mounted as shown in FIGS. 3 and 4 on the outlet side of the cylindrical slotted separator screen of the mill. The tip of the probe was a one-half inch diameter flat tip 350 watt power supply manufactured by Branson, Inc. positioned concentrically in the separator screen about 2.5 inches from the tip of the screen. This probe was activated for about five seconds at a power level on the meter of the power supply of two. The pressure in the milling chamber dropped immediately to the initial pressure reading of 0.4 bar. The power to the sonic probe was discontinued and in the next thirty minutes the chamber pressure again rose to the shut off value. Again, a short burst of sonic energy from the probe reduced chamber pressure to the initial level. This was repeated several times with the same effect over a range of operating conditions.

Hence, the present method can be used continuously or intermittently during the milling process to maintain an open screen during the milling process. This method can also be used to dislodge blockage from the screen once plugging occurs.

The present invention provides the advantage of extending the useful run time of a grinding mill operating continuously before shutting down the mill to clean the separator screen. The capability of this technology allows one to use finer grinding media and finer grinding media produce finer dispersions in a more cost effective manner. The present invention allows a practitioner of this technology to use more polydisperse and cheaper grinding beads i.e., less sieving and preconditioning of the grinding media to reduce production costs. The present invention allows the processing of larger particles that would normally cause screen plugging and result in shutdown of the mill. Finally, the present invention extends the commercially useful process latitude of existing bead milling technology to continuously prepare dispersed systems.

While there has been shown and described what are at present considered the preferred embodiments of the present invention, it will be obvious to those skilled in the art that various changes, alterations and modifications may be made therein without departing from the scope of the invention as defined by the appended claims.

What is claimed is:

1. A milling apparatus comprising:

a milling chamber having an inlet port for introducing media to be milled and an outlet port for discharging milled media;

grinding means within said chamber;

a screen covering the outlet port side;

an ultrasonic probe positioned on the outlet side of said screen;

a pressure sensor for measuring pressure within said milling chamber; and control means for activating said ultrasonic probe when pressure in said chamber reaches a predetermined value thereby unclogging said screen.

2. The apparatus according to claim 1 further comprising:

a power supply coupled to said ultrasonic probe.

3. The apparatus according to claim 1 wherein said grinding means comprises polymer beads.

4. The apparatus according to claim 1 further comprising:

a rotatable shaft positioned in the milling chamber for agitating the grinding means and media within the chamber.

5. The apparatus according to claim 4 further comprising:

eccentric and concentric milling disks mounted on said shaft.

6. A method for eliminating screen plugging in a grinding mill comprising:

introducing a dispersion of solid particles into a grinding mill chamber;

grinding the dispersion of solid particles in the grinding mill chamber;

discharging the ground solid particles through an outlet screen in fluid communication with the grinding mill chamber;

monitoring pressure within the grinding mill chamber; and activating an ultrasonic probe positioned behind the outlet screen when pressure in the grinding mill chamber reaches a predetermined value.

* * * * *